US006070695A

United States Patent [19]

Ohtaka et al.

[11] Patent Number: 6,070,695

[45] Date of Patent: Jun. 6, 2000

[54] SILENCER

[75] Inventors: Akihiko Ohtaka; Nobuyuki Yoshitoshi; Hirofumi Ogawa, all of Hamamatsu, Japan

[73] Assignee: Kabushiki Kaisha Yutaka Giken, Shizuoka-ken, Japan

[21] Appl. No.: 08/583,625

[22] Filed: Jan. 5, 1996

[30] Foreign Application Priority Data

Jan. 11, 1995 [JP] Japan ..... 7-002451
Jan. 11, 1995 [JP] Japan ..... 7-002452

[51] Int. Cl.[7] ..... F01N 7/18

[52] U.S. Cl. ..... 181/282; 181/228

[58] Field of Search ..... 181/227, 228, 181/243, 252, 256, 282

[56] References Cited

U.S. PATENT DOCUMENTS

| | | | |
|---|---|---|---|
| 3,903,987 | 9/1975 | Brown et al. | 181/282 |
| 3,945,460 | 3/1976 | McMillan | 181/282 |
| 4,998,597 | 3/1991 | Bainbridge et al. | 181/228 X |
| 5,350,888 | 9/1994 | Sager, Jr. et al. | 181/256 X |
| 5,627,351 | 5/1997 | Okuma et al. | 181/228 X |

*Primary Examiner*—Khanh Dang

*Attorney, Agent, or Firm*—Townsend & Banta

[57] ABSTRACT

A silencer comprising an outer sleeve made of a aluminum or an aluminum alloy, an inner sleeve made of a iron or steel, and acoustic material inserted between the outer sleeve and the inner sleeve. An end cap for closing a downstream end of the silencer comprising a first member made of iron or steel which is formed into a shape of the end cap, and a second member made of aluminum metal which is formed into the same shape as the outline of the first member, the peripheral portion of the first member and the peripheral portion of the second member being laminated. An end plate made of aluminum being mounted on an upstream end of the silencer. Clamping members made of iron or steel including female or male screws are secured to the end plate. An exhaust pipe is provided with a mounting seat at a fixed position thereof. The silencer can be secured to the mounting seat by means of the clamping members and bolts or nuts made of iron or steel. The end cap can be welded to a part of the outer sleeve. Caulking is not necessary in the last process of production of the silencer. Since on the upstream side, the silencer can be connected with an exhaust pipe by connection of iron or steel clamping members, even in the case where the clamping members are thermally expanded, it is possible to improve dependability on connection of the silencer with an exhaust pipe.

9 Claims, 5 Drawing Sheets

SILENCER

BACKGROUND OF THE INVENTION

1. Field of the Invention

The present invention relates to a silencer having an outer sleeve made of an aluminum or aluminum alloy, and is intended particularly for improvement in efficiency of the production of a silencer and improving dependability of connection of a silencer with an exhaust pipe, by improving a structure of connection of the outer sleeve with an iron or steel member.

2. Description of the Prior Art

A silencer is composed of an outer sleeve, an inner sleeve formed by a punching sheet, and acoustic material inserted between the outer sleeve and the inner sleeve. The silencer is connected with an exhaust pipe for introducing an exhaust pipe at one end of the silencer, and with a discharge pipe at the other end thereof.

In the silencer due to the lightweight of body cars and bikes to which the silencer is applied, an outer sleeve of the silencer is mostly made of aluminium. However, since the inside of the silencer is exposed to hot exhaust gas, an inner sleeve and an end cap for closing a downstream end of the inner sleeve are generally made of iron or steel.

However since aluminum or aluminum alloy cannot be welded with iron or steel connection of aluminium or an aluminum alloy with iron or steel is made by caulking or clamping with bolts. However, if connection of an outer sleeve made of an aluminum or an alluminum alloy with an end cap made of iron or steel is made only by caulking, when heat of exhaust gas is transmitted to the silencer, looseness of caulked parts is occasionally caused by differences in the coefficient of thermal expansion of aluminum or an aluminum alloy and iron or steel.

Referring to FIG. 6, a conventional silencer is illustrated. At an upstream end of a silencer shown in FIG. 6, a unit of an inner sleeve 53 made of iron or steel and an end cap 56 made of iron or steel was previously made by welding the former to the latter, and the unit is inserted into an outer sleeve 51 through acoustic material 54, and addition supplementary member 55 is attached to the unit from the outside of the unit. The peripheral portion of the supplementary member 55 is lapped in an end portion of the outer sleeve 51 and caulked together with the end portion of the outer sleeve 51, and then the supplementary member 55 is welded to the outer sleeve 51.

Further, at a connection of the silencer 50 on the upstream side with an exhaust pipe, a body 52 of castings or forgings made of aluminum is welded to the outer sleeve. The body 52 has a hole for receiving the exhaust pipe 59 at the center of the body. A plurality of tapped holes 52*a* are arranged around the hole for receiving the exhaust pipe. On the other hand, a flange-like mounting seat 57 also made of iron or steel is welded to the exhaust pipe 59 at the fixed position thereof. The mounting seat 57 has a plurality of bolt holes 57*a* at the corresponding positions to the respective tapped holes 52*a*. When the silencer 50 is attached to an exhaust pipe 59, first, the body 52 is engaged with the exhaust pipe 59, and steel bolts 58 are screwed into the tapped holes 52*a* through bolt holes 57*a* of the mounting seat 57.

However, in the above-mentioned structure of the conventional silencer, after the fixed inward parts have been inserted into the outer sleeve, at the last process, the end portion of the outer sleeve 51 is caulked together with the supplementary member 55 and the end cap 56. Accordingly, since caulking work for the final product is weighty and, there are problems since the apparatus for holding the outer sleeve is large sealed, and that close attention is needed to clamping and handling during production of a silencer so that the outer sleeve is not damaged or collapsed.

Further, there is a possibility that on the upstream side of the silencer due to expansion and contraction of the body 52 and the bolts 58 by driving and stopping the engine, looseness of the bolts 58 against the tapped holes 52*a* is caused. Accordingly, there is a dependablity on a connection of the silencer with an exhaust pipe.

SUMMARY OF THE INVENTION

Accordingly, it is one object of the present invention to provide a silencer which can be reasonably produced without carrying out caulking at or near the end of production of the final product and which can be connected with an exhaust pipe rigidly and without looseness of the silencer against the exhaust pipe.

In order to solve the above-mentioned object of the present invention, in a silencer comprising an outer sleeve made of aluminum or aluminum alloy, and an inner sleeve made of steel and acoustic material inserted between the outer sleeve and the inner sleeve, the present invention is characterized in that an end cap having a hole for receiving a discharge pipe for discharging exhaust gas is mounted on a downstream end of the silencer, in which the end cap comprises a first member made of the steel which is formed into a shape of the end cap and a second member made of aluminum or an aluminum alloy which is formed into the same shape as an outline of the first member, the peripheral portion of the first member and the peripheral portion of the second member are wound together and caulked together, and the inner sleeve is welded to the first member, while the outer sleeve is welded to the second member.

The above-mentioned structure of connection according to the present invention enables the end cap to be produced as a part formed by winding a first member and a second member. Accordingly, in the caulking process, lightweight first member and second member simply needed to be handled, and therefore, caulking work becomes easy, and damages to products can be lessened.

Further, since the second member made of iron or steel is disposed to the peripheral portion of the end cap, the second member and the outer sleeve which are brought into contact with each other when the end cap is attached to a silencer body are made of the same material, which enables the second member and the outer sleeve to be connected with each other by welding. Since in the welding process, big force is not applied to the second member and the outer sleeve, and therefore these parts are rarely damaged, improvement in efficiency for the manufacturing process of a silencer can be achieved. Further, since connected parts are made of the same metal, coefficients of thermal expansion of the two connected parts are equal to each other, and therefore even when the respective parts forming the silencer are expanded or contracted together with driving and stopping the engine, no distortion is produced.

Further, the present invention is characterized by an engaging portion such as hole, notch, or hollow. Accordingly, when the first and second members are caulked together, a part of the second member is intruded into the engaging portion so that the first and second members can be rigidly secured with each other and slipping off of the two hardly occur.

Further, the present invention is characterized in that an end plate made of aluminum which determines an end of the silencer is mounted on an upstream end of the silencer, clamping members made of iron or steel including a female screw or a male screw are secured to the end plate, an exhaust pipe is provided with a flange-like mounting seat at a fixed position thereof, and the silencer can be secured to the mounting seat by means of the clamping members and bolts or nuts made of iron or steel. Accordingly, since either of the clamping members and bolts can be used them made of iron or steel, even in a case where the temperature of the exhaust pipe and silencer is increased and decreased repeatedly together with driving and stopping the engine, and therefore looseness of the silencer against an exhaust pipe cannot be produced.

DETAILED DESCRIPTION OF THE PREFERRED EMBODIMENT

Figure 1:
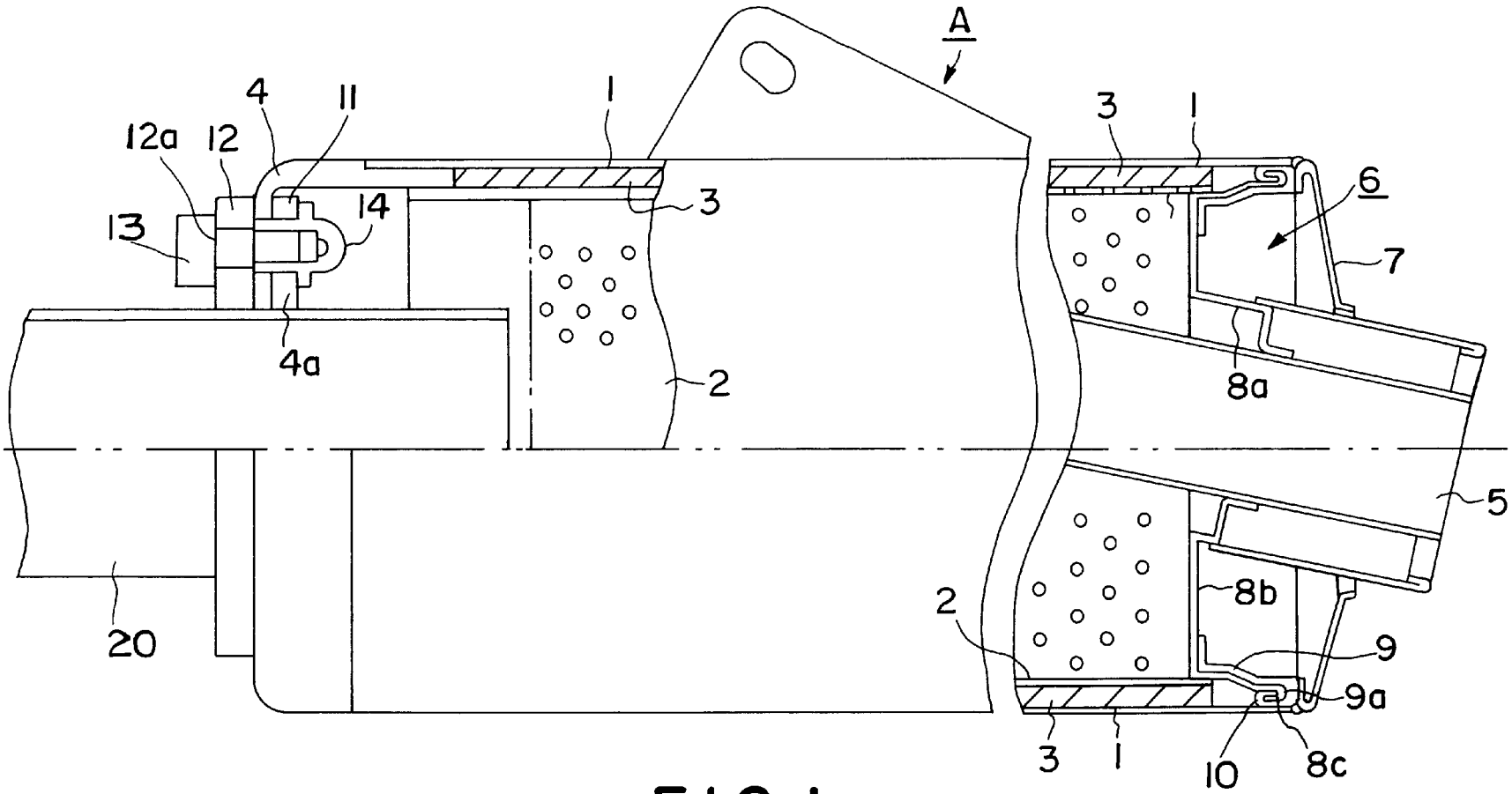
FIG. 1 is a sectional view of a silencer according to the present invention.

Referring to FIG. 1, silencer A has an outer sleeve 1 made of aluminum or an aluminum alloy such as aluminum or aluminum alloy, an inner sleeve 2 which is made by forming a punching sheet made of iron or steel such as steel or stainless steel and having a plurality of holes into the inner sleeve, acoustic or sound absorbing material 3 such as glass wool inserted between the outer sleeve and the inner sleeve. A downstream end of the silencer A is closed by an end cap 6 having a hole for receiving a discharge pipe 5, and an end cover 7 is secured to end cap 6 by welding. Further, an upstream end of silencer A is closed by an end plate 4 having a hole for receiving exhaust pipe 20, in which end plate 4 is connected with a flange-like mounting seat 12 with which exhaust pipe 20 is provided, by bolts 13.

Figure 2:
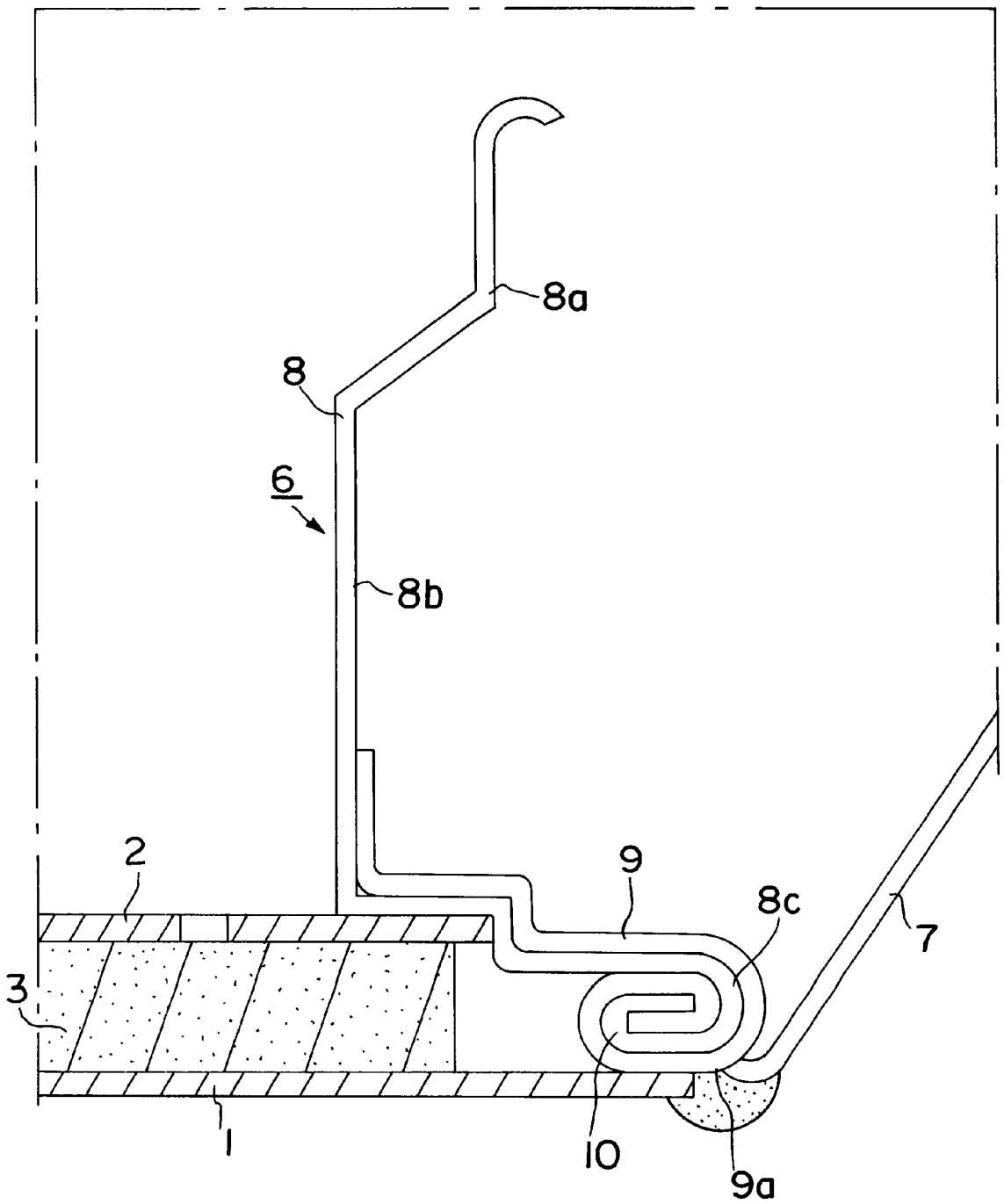
FIG. 2 is a sectional view of a part of the silencer including an end cap.
Figure 3A:
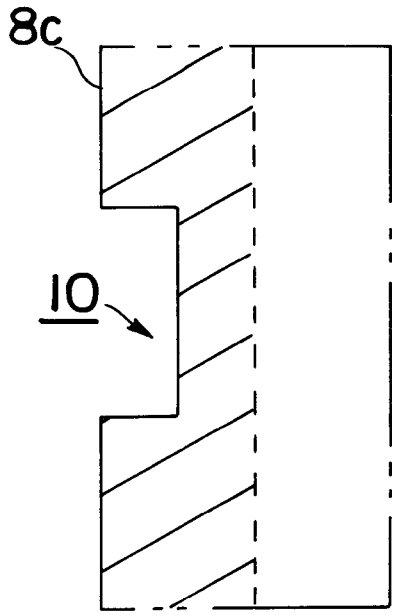
FIGS. 3 (*a*), (*b*), (*c*) are views for showing an engaging portion formed in a first member of an end cap, respectively.
Figure 3B:
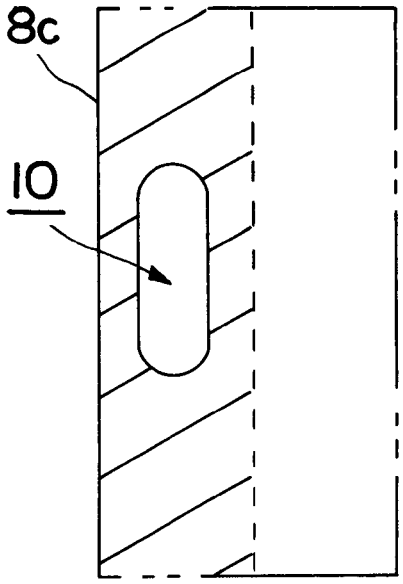
Figure 3C:
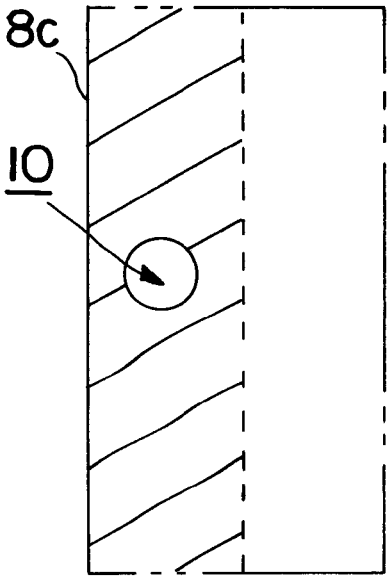

First, referring to FIG. 1, FIG. 2 and FIGS. 3 (*a*), (*b*), (*c*), a downstream end of silencer A is described in detail. In silencer A, caulking width is not needed for outer sleeve 1, which has a length equal to that of the body of silencer A.

End cap 6 comprises a first member 8 into which a sheet made of the same material as material of inner sleeve 2 (iron or steel) is formed, a second member into which a sheet made of the same material as material of outer sleeve 1 (aluminium or aluminum alloy) is formed, in which second member 9 is disposed outside first member 8, and the peripheral portions of first and second members 8, 9 are caulked together so that first and second members 8, 9 can be held as a unit.

First member 8 is made by press-forming a blank sheet of iron or steel into the first member, in which the blank sheet is formed into a shape having a projecting hole portion 8*a* for receiving discharge pipe 5, near at the center thereof, a base portion 8*b* with the periphery which can be in contact with inner sleeve 2, and peripheral portion 8*c* having a corresponding shape to that of the inside of outer sleeve 1. The whole first member has a ringed shape.

Further, the peripheral portion 8*c* of first member 8 has a caulking width with second member 9, in which as shown in FIGS. 3 (*a*), (*b*), (*c*), the peripheral portion 8*c* of first member 8 has an engaging portion 10 such as a projection, a notch or a hole. When the peripheral porion 8*c* of first member 8 and second member 9 are laid one on top of another and caulked together, aluminum or an aluminum alloy of material of second member 9 is inserted into engaging portion 10 so that first member 8 can be rigidly connected with second member 9.

Second member 9 is made by press-forming a blank sheet made of aluminum or an aluminum alloy into such a shape that at least a part of the second member goes along the peripheral portion 8*c* of first member 8, and the peripheral portion 9*a* of second member 9 is formed with a caulking width with first member 8.

First member 8 and second member 9, which have been formed into the above-mentioned shapes, respectively, are laid one on top of another, and both the peripheral portions 8*c*, 9*a* are bent outward, the peripheral portion 8*c* of first member 8 is wrapped in the peripheral portion 9*a* of second member 9, and both the peripheral portions 8*c*, 9*a* are caulked together under the above-mentioned condition so that first member 8 and second member 9 can be held as a unit to form end cap 6.

When silencer A is produced, after end cap 6 has been formed, first member 8 is welded to inner sleeve 2, and then the inner sleeve 2 and end cap 6 are attached at the same time to outer sleeve 1, by which a downstream end of silencer A can be closed. In this time, since second member 9 made of aluminum is in contact with outer sleeve 1, silencer A can be formed by making the peripheral portion of end cap 6 coincident with an end of outer sleeve 1 and besides making the portion where the peripheral portion of end cap 6 is coincident with the end of outer sleeve 1 touch end cover 7 made of aluminum, and by welding the three components at the same time, by which silencer A can be formed.

As mentioned hereinabove, in the present invention, first member 8 and second member 9 can be provided as a part previously made by lapping second member 9 over first member 8 and caulking both the members 8. 9 together. Accordingly, caulking work is not needed in the last process as usual. Therefore, there is no fear that an outer sleeve is damaged. Further, since in the caulking process, a light-weight first member 8 and second member 9 are handled, for producing a silencer is easy, and in turn the danger that an end cap is damaged is lessened. Further, since the first and second members 8, 9 are made of the same metal, even if the first and second members 8, 9 are heated or cooled, no distortion is produced, because both the members are expanded or contracted in the same extent.

Further, since first member 8 and second member 9 are rigidly secured to each other through engaging portion 10 provided in the peripheral portion 8*c* of first member 8, even if there is a possibility that a relative difference between the first member 8 and the second member 9 is produced by a difference of coefficients of thermal expansion of the first member and the second member of when heat of exhaust gas is transmitted to a silencer A, the occurrence of a relative difference between the first member 8 and the second member 9 can be restrained so that a stable state of connection of the first member with the second member can be maintained.

Figure 4:
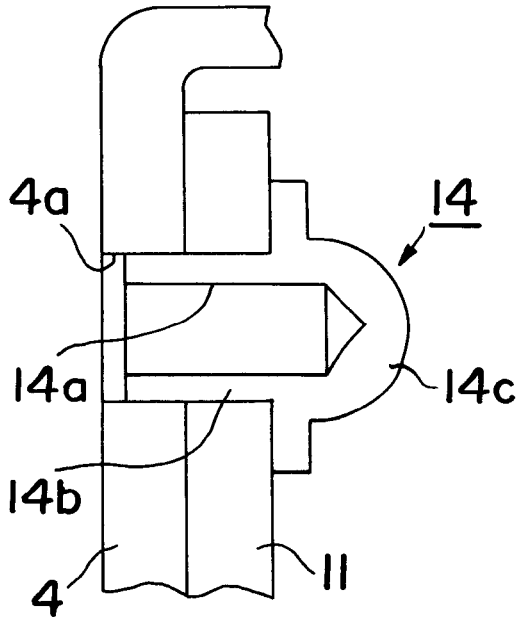
FIG. 4 is a sectional view for showing a connection between the silencer and an exhaust pipe.
Figure 5A:
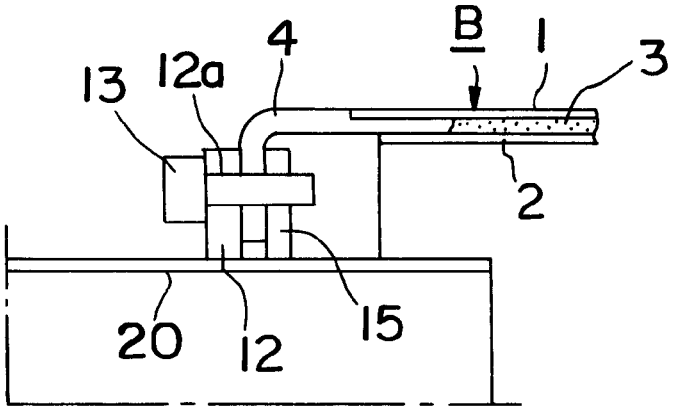
FIGS. 5 (*a*), (*b*), (*c*) are views for showing another embodiment of a connection between the silencer and an exhaust pipe, respectively.
Figure 5B:
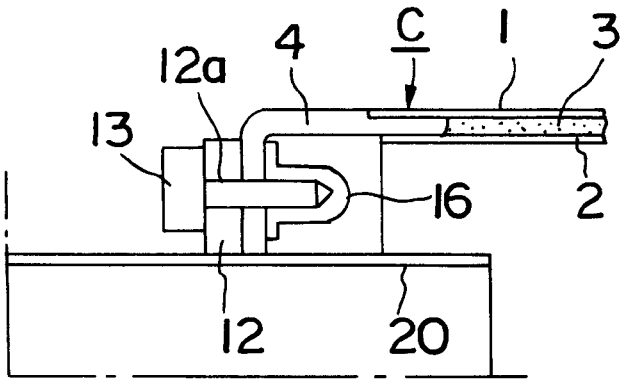
Figure 5C:
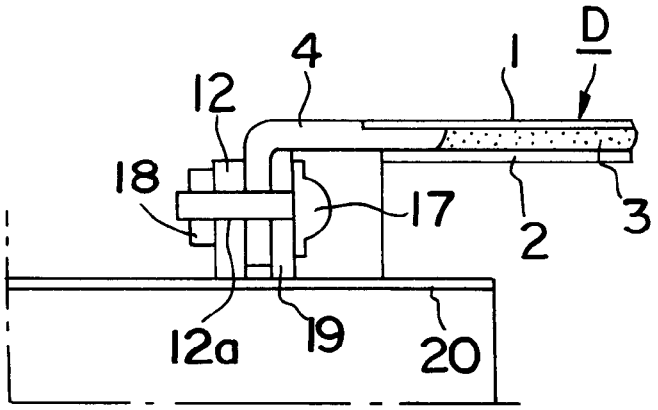
Figure 6:
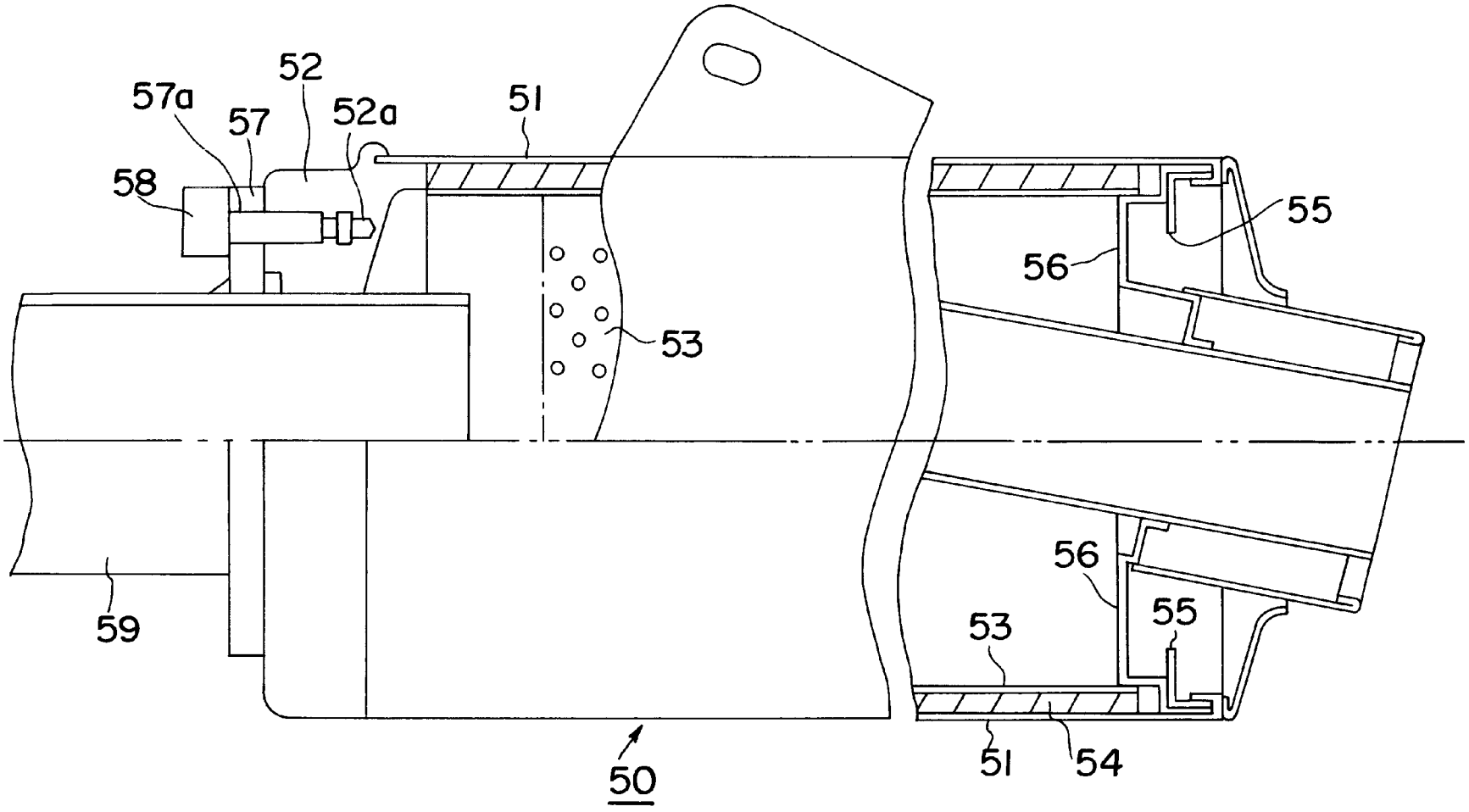
FIG. 6 PRIOR ART
FIG. 6 is a view of a conventional connection between a silencer and an exhaust pipe.

Then, referring to FIG. 1, FIG. 4, and FIGS. 5 (*a*), (*b*), (*c*), an upstream end of silencer A is described in detail. In FIG.

1, end plate 4 having a given shape is rigidly secured to an upstream end of outer sleeve 1 (a side of exhaust pipe 20) by welding to close silencer A, by which an expansion room of exhaust gas is formed between end plate 4 and the end cap. A hole for receiving exhaust pipe 20 is formed at the center of end plate 4. A plurality of holes 4*a* are formed round the hole for receiving exhaust pipe 20 at regular intervals.

Further, flange-like mounting seat 12 is secured to exhaust pipe 20 for introducing exhaust gas from the engine to the outside air, in the vicinity of an end of the exhaust pipe 20. The mounting seat is formed with a plurality of bolt holes 12*a* at the corresponding positions to holes 4*a* formed in end plate 4.

Circular back plate 11 is disposed inside end plate 4, and nut 14 as tightening member is secured to back plate 11. Back plate 11 and nuts 14 are made of iron or steel such as steel or steel alloy, respectively. Back plate 11 has a plurality of holes formed at the same intervals as intervals of holes 4*a* formed in end plate 4, and nuts 14 are secured to the respective holes formed in back plate 11 by welding or by press-fit by means of serration.

As shown in FIG. 4, nut 14 is formed as a box nut in which screw hole 14*a* does not go through toward the top portion of the nut, and a cylindrical portion 14*b* of nut 14 is formed into such a shape that the cylindrical portion can fit in holes formed in back plate 11 and end plate 4. When nut 14 is secured to back plate 11, head 14*c* of nut 14 is welded to back plate 11 or cylindrical portion 14*b* is press-fitted in which the cylindrical portion 14*b* is formed with serration.

Irrespective of a method of securing nut 14 to back plate 11 of welding or press-fitting, cylindrical portion 14*b* of nut 14 is formed into such a shape that the cylindrical portion can be press-fitted into hole 4*a* formed in end plate 4 so that the nut 14 cannot be moved against the end plate 14 during carrying out a connecting work of silencer A with exhaust pipe 20. The length of cylindrical portion 14*b* of nut 14 is shorter than the sum of the thickness of back plate 11 and the thickness of end plate 4 in such a manner that when nut 14 has been press-fitted into holes formed in back plate 11 and end plate 4, the nut 14 cannot be brought into contact with mounting seat 12.

Then, the procedure for connecting the above-mentioned silencer A with exhaust pipe 20 is described. First, silencer A is held in given position and then exhaust pipe 20 is engaged with end plate 4, so that nut 14 fixed to end plate 4 is opposed against bolt hole 12*a* formed in mounting seat 12 which has been secured to exhaust pipe 20. Thereafter, bolt 13 made of steel is inserted and screwed into nut 14 from a side of mounting seat 12, by which silencer A can be connected with exhaust pipe 20.

Accordingly, since connection of silencer A with exhaust pipe 20 is made by screwing bolt 13 made of iron or steel into nut 14 made of iron or steel metal, even in a case where heat of exhaust gas is applied to nut 14 and bolt 13, looseness of nut 14 against bolt 13 is not produced, and so it is possible to improve dependability on connection of silencer A with exhaust pipe 20.

Further, referring to FIGS. 5 (*a*), (*b*), (*c*) other embodiments of a connection of a silencer with an exhaust pipe are illustrated, wherein like reference characters designates like parts or corresponding parts which fulfil like functions, about which description is omitted.

In silencer B shown FIG. 5 (*a*), a back plate 15 made of iron or steel, which is disposed inside an end plate 4, has a plurality of tapped holes as connection members. A method of securing back plate 15 to end plate 4 is particularly limited. For example, there is a method that the inside of end plate is formed with a hollow having the corresponding shape to the outline of back plate 15, and back plate 15 is press-fitted into the hollow, and other methods.

In a silencer B constructed hereinabove, when the silencer B is connected with an exhaust pipe 20, a bolt 13 is screwed into a tapped hole of back plate 15. Accordingly, the connection of the silencer with exhaust pipe 20 is made by connection of iron or steel with iron or steel, therefore it is possible to improve dependability on connection of the silencer with exhaust pipe 20.

In a silencer C shown in FIG. 5 (*b*), without using a back plate, a nut 16 made of iron or steel is directly secured to the inside of end plate 4. A method of securing nut 16 to end plate 4 is not limited particularly. For example, there are a method that nut 16 is formed with a projection at the corresponding surface of nut 16 to a surface of end plate 4, and the projection is cut into end plate 16 so that the projection is secured to the end plate 4, or the projection is press-fitted into a bolt hole formed in end plate 4, and other methods.

In a silencer constructed hereinabove, in the same manner as in each of the above-mentioned embodiments, when the silencer is connected with an exhaust pipe, a connection of iron or steel with iron or steel is formed, and so it is possible to improve dependability on a connection of the silencer with an exhaust pipe.

In a silencer D shown in FIG. 5 (*c*), back plate 19 is displaced inside end plate 4, bolt 17 as connecting member is secured to the back plate 19, and the back plate 19 and the bolt 17 is secured to end plate 4. Bolt 17 should not be necessarily headed bolt but may be a stud bolt as shown in FIG. 5 (*c*).

In a silencer D constructed hereinabove, when a silencer D is engaged with exhaust pipe 20, bolt 17 is inserted into a bolt hole 12*a* formed in mounting seat 12. Then, bolt 17 projected from mounting seat 12 is screwed into nut 18, by which the silencer can be connected with exhaust pipe 20. In this case, a connection of iron or steel with iron or steel is also formed in the same manner as in each of the above-mentioned embodiments, and so it is possible to improve dependability on a connection of the silencer with an exhaust pipe.

By the above-mentioned structure of connection, even in a case where the temperature of the exhaust pipe and silencer is increased and decreased repeatedly together with driving and stopping the engine, since clamped parts are made of near like materials, coefficients of thermal expansion of the clamped parts are near equal, and therefore looseness between both the clamped parts cannot be produced. Accordingly, it is possible to improve dependability on clamping, and there is no trouble that exhaust gas will escape from the connection of a silencer with the exhaust pipe.

Although preferred embodiments of the present invention have been described hereinabove, variations thereto will occur to those skilled in the art within the scope of the present inventive concepts. Accordingly, it is understood that the present invention is not limited to the specific embodiments thereof. The scope of the present invention is therefore to be determined solely by the appended claims.

What is claimed is:

1. A silencer having an upstream end connected to an exhaust pipe from an engine and a downstream end connected to a discharge pipe, said silencer comprising an outer sleeve made of aluminum or aluminum alloy, an inner sleeve made of iron or steel and an acoustic material inserted between the outer sleeve and the inner sleeve, an end cap having a hole and a peripheral portion mounted on the downstream end of said silencer, said end cap comprising a first member having a peripheral portion and an engaging portion, made by forming iron or steel into a shape of an end cap, and a second member having a peripheral portion, made by forming aluminum or an aluminum alloy into an outline shape of said first member, a discharge pipe inserted into said hole of said end cap for discharging exhaust gas, wherein the peripheral portion of the first member of said end cap and the peripheral portion of the second member of said end cap are wound together and caulked together, and the inner sleeve of said silencer is welded to the first member of said end cap, while the outer sleeve of said silencer is welded to the second member of said end cap.

2. The silencer as in claim 1, wherein the second member of said end cap is intruded into said engaging portion of said first member of said end cap and wound and caulked together with the first member of said end cap, so that the first member of said end cap and the second member of said end cap can be rigidly secured together.

3. A silencer as claimed in claim 2, wherein the engaging portion is a notch.

4. A silencer as claimed in claim 2, wherein the engaging portion is a hole.

5. The silencer as claimed in claim 1, further comprising an end plate made of aluminum or an aluminum alloy defining an end of the silencer mounted on the upstream end of said silencer, clamping members made of iron or steel including female screws or male screws secured to said end plate, an exhaust pipe provided with a flange-like mounting seat at a fixed position thereof, wherein the silencer can be secured to the mounting seat by means of the clamping members and bolts or nuts made of iron or steel.

6. The silencer as in claim 2, further comprising an end plate made of aluminum or aluminum alloy defining an end of the silencer mounted on the upstream end of said silencer, clamping members made of iron or steel including female screws or males screws secured to said end plate, and an exhaust pipe provided with a flange-like mounting seat at a fixed position thereof, wherein the silencer can be secured to the mounting seat by means of the clamping members and bolts or nuts made of iron or steel.

7. The silencer as in claim 3, further comprising an end plate made of aluminum or aluminum alloy defining an end of the silencer mounted on the upstream end of said silencer, clamping members made of iron or steel including female screws or males screws secured to said end plate, and an exhaust pipe provided with a flange-like mounting seat at a fixed position thereof, wherein the silencer can be secured to the mounting seat by means of the clamping members and bolts or nuts made of iron or steel.

8. The silencer as in claim 4, further comprising an end plate made of aluminum or aluminum alloy defining an end of the silencer mounted on the upstream end of said silencer, clamping members made of iron or steel including female screws or males screws secured to said end plate, and an exhaust pipe provided with a flange-like mounting seat at a fixed position thereof, wherein the silencer can be secured to the mounting seat by means of the clamping members and bolts or nuts made of iron or steel.

9. The silencer as in claim 3, wherein said engaging portion is a projection.

* * * * *